United States Patent [19]

Presser et al.

[11] Patent Number: 4,636,754

[45] Date of Patent: Jan. 13, 1987

[54] HIGH PERFORMANCE INTERDIGITATED COUPLER WITH ADDITIONAL JUMPER WIRE

[75] Inventors: Adolph Presser, Kendall Park; Stewart M. Perlow, Marlboro, both of N.J.

[73] Assignee: RCA Corporation, Princeton, N.J.

[21] Appl. No.: 666,722

[22] Filed: Oct. 31, 1984

[51] Int. Cl.[4] ..... H01P 5/18

[52] U.S. Cl. ..... 333/116; 333/238

[58] Field of Search ..... 333/116, 117, 120, 128, 333/136, 109, 246, 238

[56] References Cited

U.S. PATENT DOCUMENTS

| | | | |
|---|---|---|---|
| 3,208,003 | 9/1965 | Sterzer | 330/61 A |
| 3,516,024 | 6/1970 | Lange | 333/116 |
| 4,178,568 | 12/1979 | Gunton | 333/116 |
| 4,211,986 | 7/1980 | Tajima | 333/116 |

FOREIGN PATENT DOCUMENTS

| | | | |
|---|---|---|---|
| 0128652 | 10/1979 | Japan | 333/116 |
| 0086505 | 7/1981 | Japan | 333/116 |

OTHER PUBLICATIONS

"Interdigitated Microstrip Coupler Design", By: A. Presser, *IEEE Transactions on Microwave Theory and Techniques*, vol., MTT-26, No. 10, Oct. 1978, pp. 801-805.

Kumar et al, "Monolithic GaAs Interdigitated 90° Hybrids with 50- 25- Ohm Impedances", 1982 *IEEE Microwaves & Millimeter Wave Circuits Symposium*, Dallas, TX, 1982.

"Interdigitated Strip-Line Quadrature Hybrid", By: J. Lange G-MTT Int. *Microwave Symposium Digest*, pp. 10-13, May 1969.

"Interdigitated Stripline Quadrature Hybrid", By: J. Lane, *IEEE Transactions on Microwave Theory and Techniques*, Dec. 1969, pp. 1150-1151.

"Unfolding", The Lange Coupler, By: R. Waugh et al., *IEEE Transactions on Microwave Theory and Techniques*, Nov. 1972, MTT-20, pp. 777-779.

*Primary Examiner*—Eugene R. La Roche
*Assistant Examiner*—Benny T. Lee
*Attorney, Agent, or Firm*—Joseph S. Tripoli; Robert L. Troike; Robert Ochis

[57] ABSTRACT

A four-port folded interdigitated coupler has two short conductive strips and three full length conductive strips disposed between the short strips. The full length strips are ¼ wavelength long at a design frequency. The sum of the lengths of the short strips is ¼ wavelength at that design frequency. The ends of the short strips remote from the ports are connected together and to the center one of the three full length strips by conductive jumpers. In one embodiment the two full length strips which are not connected to the short strips are connected by a conductive jumper at substantially the same longitudinal position as the jumpers which connect the ends of the two short strips. In this embodiment, the two short strips may have equal lengths or they may have unequal lengths. When their lengths are unequal, their jumpers and the associated jumper between the two outer full length strips are positioned off-center with respect to the longitudinal length of the full length strips. With the short strips having unequal lengths, the jumper between the two full length strips may be omitted. In another embodiment, the short strips have unequal lengths and no jumper connects the outer full length strips at the longitudinal position of the short strip jumpers.

8 Claims, 5 Drawing Figures

HIGH PERFORMANCE INTERDIGITATED COUPLER WITH ADDITIONAL JUMPER WIRE

The present invention relates to microwave circuits and more particularly to interdigitated couplers.

Interdigitated stripline couplers are disclosed in U.S. Pat. No. 3,516,024 to Julius Lange and in an article by Lange entitled "Interdigitated Stripline Quadrature Hybrid" *IEEE Transactions on Microwave Theory and Techniques,* December 1969, pp. 1150–1151. Both the patent and the article are incorporated herein by reference. These couplers are disclosed both in direct form and a folded form. These couplers are each comprised of parallel, interdigitated microstrip conductors disposed on one major surface of a solid dielectric microstrip substrate which has a wide ground conductor disposed on its other major surface.

In the direct form, each of the four interdigitated strips is a single continuous conductor strip having a length of one-quarter wavelength (λ/4) at a design frequency. Nearest, non-adjacent ones of the four strips are connected together by conductive wire jumpers in pairs at both ends. Each of the resulting four connections forms a port of the coupler. In this direct configuration the direct and coupled ports are diagonally opposite as are the input and isolated ports.

In the folded or crossed form there are five conductive strips. The inner three of these are each one quarter wavelength (λ/4) long at the design frequency. The two outer most strips are only half the length (λ/8) of the inner three strips. At each extreme end of the coupler there are only four conductive strips, the nearest, non-adjacent ones of these four interdigitated strips at that end are tied together by conductive wire jumpers as in the direct form to form the four coupler ports. The half length strips are connected to each other by conductive wire jumpers at their ends remote from their port connections. These jumpers connect each of the half length strips to the center of the full length strip which is connected to the same ports to which the half length strips connect. In this folded form the direct and coupled ports are on one side of the coupler and the input and isolated ports are on the other side. This makes the folded form preferred in a number of microwave circuits, such as balanced amplifiers, which require two inputs derived from a common source.

The prior art folded interdigitated coupler theoretically has a very wide operating bandwidth. However, because of the bandwidth limitations of other components of the microwave circuits in which such couplers are used, these couplers are normally operated over a substantially narrower frequency band which is centered about their design center frequency. We have found that as the design center frequency increases to 5 GHz and above the operation of such couplers produces impedance mismatches at the ports and non-uniform coupling phase and port isolation as a function of frequency even in the relatively narrow, actual, operating frequency band. It is desirable therefore to provide a coupler that provides less mismatch and more uniform coupling and isolation over this actual operating frequency band above 5 GHz. It is further desirable that such an interdigitated coupler be of the folded type which permits the direct and coupled ports to emerge from the same side.

SUMMARY

The present invention provides such a folded interdigitated coupler by connecting the two conductive strips which are not connected to the short conductive strips to each other by an additional jumper wire located at substantially the same longitudinal position as the jumper wire which connects the short conductive strips to each other. The operation of this coupler is further improved by making the two short conductive strips different lengths. This places the jumper wires which connect the ends of the shorter sections to each other and the additional jumper wire off center with respect to the length of the other interdigitated strips. The additional jumper wire may be omitted when the short strips have unequal lengths.

DETAILED DESCRIPTION

Figure 1:
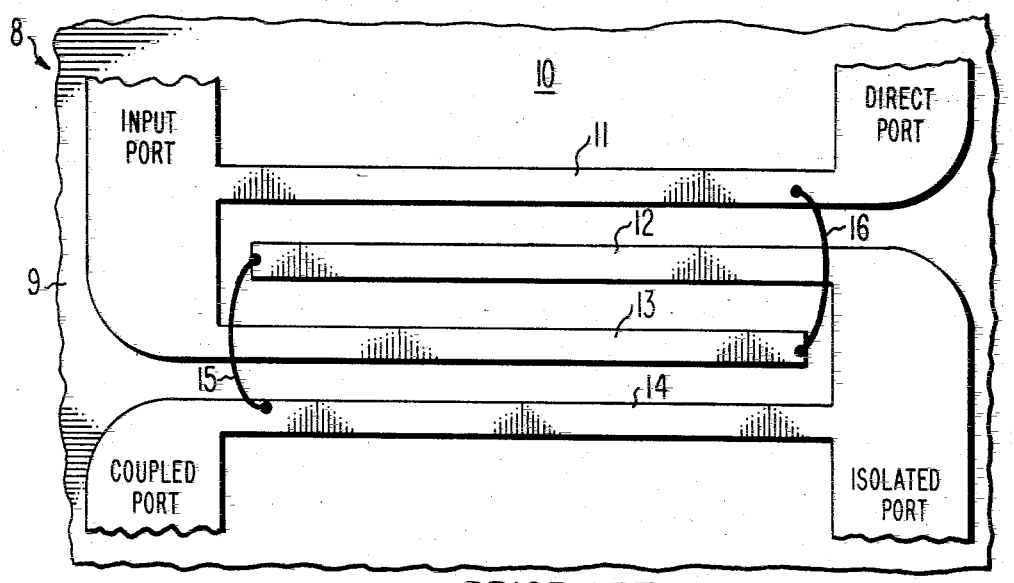
PRIOR ART Fig. 1
FIG. 1 illustrates a prior art microstrip interdigitated coupler having four equal length (λ/4) conductor strips.

A prior art direct interdigitated coupler 8 is illustrated in plan view in FIG. 1. This coupler is fabricated in microstrip form on a dielectric substrate 9 with its narrow conductive strips disposed on a major surface 10 of that substrate. A wide ground conductor (not shown) is disposed on the opposing major surface of the substrate. This coupler has four ports which are referred to as an input port, a direct port, a coupled port and an isolated port. The isolated port is diagonally opposite the input port and the coupled port is diagonally opposite the direct port. Thus, the coupled and direct ports are on opposite sides of the coupler.

A first interdigitated conductive strip 11 has one of its ends integral with the input port and its other end integral with the direct port. A second conductive strip 12 adjacent and parallel to strip 11 has one end integral with the isolated port and the other end connected to the coupled port by a conductive wire jumper 15. A third interdigitated conductive strip 13 adjacent and parallel to strip 12 has one end integral with the input port and the other end connected to the direct port by a wire jumper 16. A fourth interdigitated conductive strip 14 adjacent and parallel to strip 13 has one end integral with the coupled port and the other end integral with the isolated port. Each of the jumpers 15 and 16 may comprise multiple conductive wires or be a relatively wide thin conductive strip if desired, in order to reduce parasitic inductances. These jumpers extend from strip to strip a distance above the conductive strips they are isolated from and above the substrate. Each of the strips 11, 12, 13 and 14 is substantially ¼ wavelength long (λ/4) at the design center frequency of the coupler 8.

Figure 2:
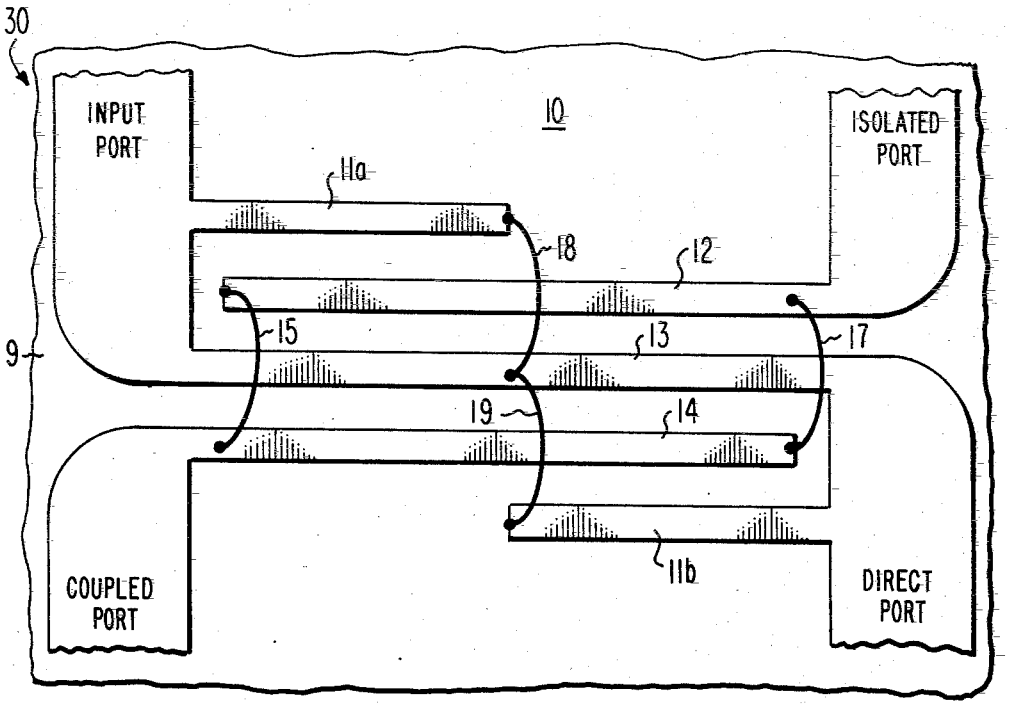
PRIOR ART Fig. 2
FIG. 2 illustrates a prior art folded coupler having two equal length (λ/8) short microstrip conductor sections.

A prior art folded or crossed interdigitated coupler 30 is illustrated in plan view in FIG. 2. This folded coupler, like the direct coupler 8, is fabricated in microstrip form on the major surface 10 of a dielectric substrate 9. A ground planar conductor (not shown) covers the major surface of the substrate 9 opposite to surface 10.

In this folded coupler, the direct port is diagonally opposite the input port, the coupled port is diagonally opposite the isolated port, and the direct and coupled ports are on the same side of the coupler. The first strip 11 of this folded coupler is split into the two portions 11*a* and 11*b* in order that the coupler may be folded to place the direct and coupled ports on the same side. The strip 11*a* has one end integral with the input port. The strip 11*b* has one end integral with the direct port. The end of strip 11*a* which is remote from the input port is connected to the end of strip 11*b* which is remote from the direct port. This connection is described in more detail below. The second strip 12 has one end integral with the isolated port and has the other end connected to the coupled port by the wire jumper 15. The third strip 13 has one end integral with the input port and the other end integral with the direct port. The fourth strip 14 has one end integral with the coupled port and the other end connected by a wire jumper 17 to the isolated port. The connection of the end of the strip 11*a* to the end of strip 11*b* is accomplished by two wire jumpers 18 and 19. Jumpers 18 and 19 each have one end connected to the longitudinal center of the third strip 13. The other end of wire jumper 18 is connected to the end of strip 11*a* and the other end of wire jumper 19 is connected to the end of strip 11*b*. The length of each of the strips 12, 13 and 14 is substantially ¼ wavelength (λ/4) at the design center frequency of the coupler. The length of each of the strips 11*a* and 11*b* is one half of that of strips 12, 13 and 14 or ⅛ wavelength (λ/8) at the design center frequency. The coupler 30 is like that described by Lange in his above cited patent.

We have found in testing interdigitated couplers like coupler 30 at high center frequencies in the range from 5 GHz to 16 GHz that even in the center of the design operating band the operating characteristics of these couplers deviate from the ideal coupling characteristics in that the coupling phase and isolation and port mismatches vary as a function of frequency. We have determined that this deviation is at least in part a result of the parasitic reactances of the center cross-over wire jumpers 18 and 19.

Figure 3:
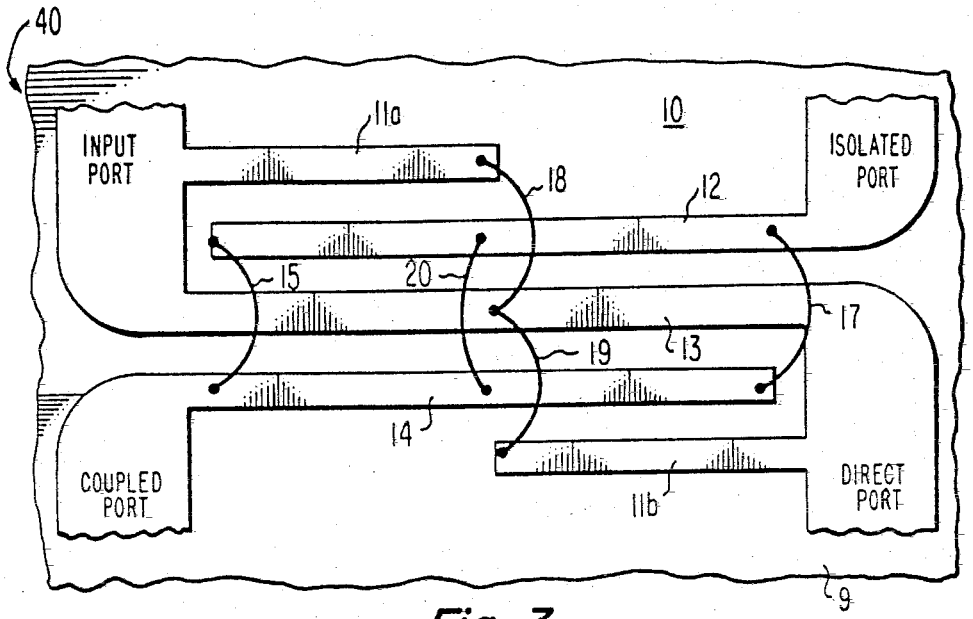
FIG. 3 illustrates a folded interdigitated coupler in accordance with the present invention having equal length (λ/8) short sections and an additional jumper wire at substantially the same longitudinal location as the jumper wire which connects the short conductive strips to each other (the additional jumper connects the strips which are not connected to the short strips)

We have discovered that by adding a conductive jumper 20 connecting conductive strips 12 and 14 at substantially the same longitudinal position (distance from the input port) as wire jumpers 18 and 19, as shown in coupler 40 in FIG. 3, the performance of these couplers at the design frequency is improved. The coupler 40 is like coupler 30 except for the addition of conductive jumper 20. The improved performance of coupler 40 is believed to be a result of improved symmetry. If the coupler 40 of FIG. 3 were unfolded by flipping line 11*b* over lines 14, 13 and 12 to become continuous with line 11*a* and by reversing the position of the direct and isolated ports, then wire jumpers 18 and 19 would both connect the longitudinal center of the now continuous strip 11 with the center of the strip 13. The wire jumper 20 would connect the longitudinal centers of the strips 12 and 14. Thus, the strips 11 and 13 would be symmetrical with the strips 12 and 14. However, if the coupler 30 of FIG. 2 were unfolded in the same way, there would be no connection between the longitudinal centers of the strips 12 and 14. Thus, strips 11 and 13 would not be symmetrical with strips 12 and 14.

We have further discovered that when the lengths of the short strips 11*a* and 11*b* in the coupler 40 are made selectively unequal with their combined length still the same as that of strips 12, 13 and 14, the operating characteristics of the coupler at the design center frequency are further improved. An improved coupler 50 in accordance with this aspect of the invention is illustrated in FIG. 4.

Figure 4:
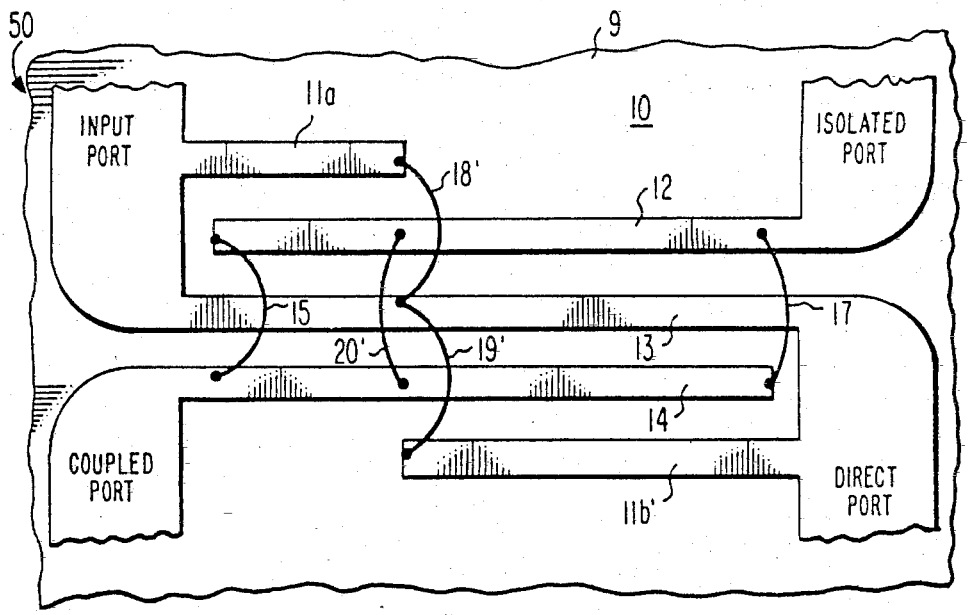
FIG. 4 illustrates a folded interdigitated coupler like that in FIG. 3, but in which the short sections have unequal lengths.

The coupler 50 in FIG. 4 is like the coupler 40 in FIG. 3, except that the short conductive strips 11*a*′ and 11*b*′ in coupler 50 are made unequal in length. The sum of the lengths of strips 11*a*′ and 11*b*′ is still equal to the length of each of the strips 12, 13 and 14. The wire jumpers 18′ and 19′ extend from the ends of strips 11*a*′ and 11*b*′ to the nearest point on the center strip 13. The jumper 20′ between strip conductors 12 and 14 is at about the same longitudinal position as wire jumpers 18′ and 19′. As a result of the unequal lengths of strips 11*a*′ and 11*b*′, the jumpers 18′, 19′ and 20′ are off-center with respect to the lengths of the strip conductors 12, 13 and 14. Thus, the distance from the input port to the jumpers 18′, 19′ and 20′ is less than the distance from these jumpers to the direct port. The unchanged elements in FIG. 4 have the same reference numerals as they have in FIG. 3.

With the short strips 11*a*′ and 11*b*′ unequal in length as in coupler 50, but with the wire jumper 20′ removed so that strips 12 and 13 are connected only at their ends, the characteristics of the coupler are still improved over those of coupler 30.

Results of a combination of physical measurements and computer analysis of folded interdigitated couplers are shown in the Table. The design center frequency of the coupler is 15 GHz with an octave bandwidth extending from 10 GHz to 20 GHz. Each wire jumper's parasitic inductance is about 0.13 nh (nanohenry). The variation of port VSWRs, the variation in isolation and the variation in the phase difference between the direct and coupled ports across the 10 GHz–20 GHz band are tabulated for four different folded coupler designs. Case A is the coupler 30 of FIG. 2 with the strips 11*a* and 11*b* having equal lengths and without any wire jumper connecting the longitudinal centers of strips 12 and 14. Case B is the coupler 40 of FIG. 3 with strips 11*a* and 11*b* having equal lengths and with the jumper 20 connecting the longitudinal centers of strips 12 and 14. Case C is the coupler 50 of FIG. 4 with the shorter short strip 11*a*′ having a length of 2/9 of ¼ wavelength (2λ/36) and the longer short strip 11*b*′ having a length of 7/9 of ¼ wavelength (7λ/36) and with the jumper 20′ at substantially the same location as the jumpers 18′ and 19′. Case D is the same as Case C except that the jumper 20′ was not present.

TABLE

| CHARACTERISTIC | at 10 GHz | at 20 GHz |
|---|---|---|
| CASE A | | |
| Input port VSWR | 1.12 | 1.33 |
| Direct port VSWR | 1.12 | 1.33 |
| Coupled port VSWR | 1.12 | 1.33 |
| Isolation | 29 dB | 20 dB |
| Phase variation across band 4.7° | | |

TABLE-continued

| CHARACTERISTIC | at 10 GHz | at 20 GHz |
|---|---|---|
| CASE B | | |
| Input port VSWR | 1.12 | 1.33 |
| Direct port VSWR | 1.1 | 1.18 |
| Coupled port VSWR | 1.1 | 1.18 |
| Isolation | 29 dB | 21 dB |
| Phase variation across band 1.5° | | |
| CASE C | | |
| Input port VSWR | 1.12 | 1.33 |
| Direct port VSWR | 1.06 | 1.1 |
| Coupled port VSWR | 1.06 | 1.1 |
| Isolation | 31.5 dB | 26 dB |
| Phase variation across band 1° | | |
| CASE D | | |
| Input port VSWR | 1.12 | 1.33 |
| Direct port VSWR | 1.06 | 1.1 |
| Coupled port VSWR | 1.06 | 1.1 |
| Isolation | 32 dB | 28 dB |
| Phase variation across band 2.6° | | |

Based on our measurements and analysis, we have concluded that the shorter strip 11*a*′ of the two short strips and the parasitics reactances associated with it and the wire jumper 18′ tend to induce non-ideal coupler behavior at a frequency above the design center frequency of the folded coupler. In a similar manner, the longer strip 11*b*′ of the two short strips and its associated wire jumper 19′ tend to induce non-ideal coupling behavior at a frequency below the design center frequency of the coupler. The result is that as compared to the couplers 40 and 30, the coupler 50 has its non-ideal behavior shifted away from the design center frequency. The coupler 50 is more nearly ideal than either coupler 30 or 40 with respect to coupling phase, isolation and port mismatches in the vicinity of its design center frequency. Since it is in this vicinity that the coupler is actually utilized, a significant improvement in the operating characteristics results.

Figure 5:
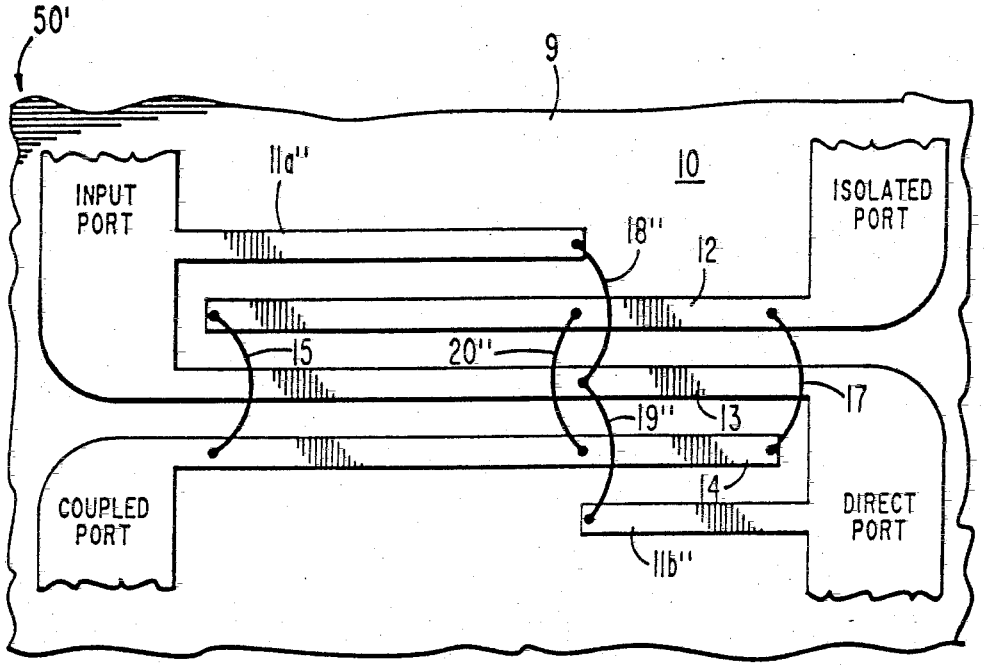
FIG. 5 illustrates a folded interdigitated coupler like that in FIG. 4, but in which the relative length of the short sections is reversed.

As the short strips 11*a*′ and 11*b*′ are made more nearly equal in length, the size of the band around the center frequency over which the coupler 50 has improved characteristics over coupler 40 tends to decrease. We have determined that as long as the strips 11*a*′ and 11*b*′ differ in length by at least one sixteenth of a wavelength ($\lambda/16$) an operating bandwidth of $\pm 10\%$ about the design center frequency has improved operating characteristics. Consequently, it is preferred that the length of one of the short strips be between 1/32 wavelength ($\lambda/32$) and 3/32 wavelength ($3\lambda/32$) at the design operating frequency and the other short strip be between 7/32 wavelength ($7\lambda/32$) and 5/32 wavelength ($5\lambda/32$), respectively. This corresponds to the length of one being between $\frac{1}{8}$ and $\frac{3}{8}$ of the length of the lines 12, 13 and 14 and the other being between $\frac{7}{8}$ and $\frac{5}{8}$, respectively of the length of the lines 12, 13 and 14. The coupler 50′ in FIG. 5 is like the coupler 50 in FIG. 4 except that the upper short conductive strip 11*a*′ in coupler 50′ is longer than the lower short conductive strip 11*b*′. The wire jumpers 18″ and 19″ extend from the ends of strip 11*a*′ and 11*b*′ to the nearest point on the center strip 13. The jumper 20″ between strip conductor 12 and 14 is at the same longitudinal position as wire jumpers 18″ and 19″. The operating characteristics of the coupler 50′ are similar to those of the coupler 50.

What is claimed is:

1. In a microstrip interdigitated microwave coupler having an input port, a direct port, a coupled port and an isolated port of the type in which:

said input and coupled ports are at a first longitudinal end of said coupler and said isolated and direct ports are at a second longitudinal end of said coupler, said input port is diagonally opposite said direct port and is connected thereto by:

a first conductive path including a first conductive strip which extends from said input port, a second conductive strip which extends from said direct port, and a first conductive jumper which interconnects the ends of said first and second strips which are remote from said ports, said first and second strips having a combined length which is substantially $\frac{1}{4}$ wavelength at a design frequency, and by a third conductive strip which is substantially $\frac{1}{4}$ wavelength long between said input port and said direct port at said design frequency and to which said first jumper also connects, said coupled port is diagonally opposite said isolated port and is connected thereto by a second conductive path including:

a fourth conductive strip extending from said isolated port and disposed between said first and third strips, a fifth conductive strip extending from said coupled port and disposed between said second and third conductive strips, a second conductive jumper connecting said fourth and fifth conductive strips near said first end of said coupler, and a third conductive jumper connecting said fourth and fifth conductive strips near said second end of said coupler, each of said fourth and fifth conductive strips being substantially $\frac{1}{4}$ wavelength long at said design frequency, the improvement comprising:

a fourth conductive jumper connecting said fourth and fifth strips at substantially the same longitudinal distance from said input port as said first conductive jumper connects to said first and second strips.

2. The improvement recited in claim 1 wherein:

said first and second conductive strips have unequal lengths whereby the distance from said input port to said first conductive jumper and said fourth conductive jumper is different than the distance from said first conductive jumper and said fourth conductive jumper to said direct port.

3. The improvement recited in claim 2 wherein said first conductive strip is between one eighth and three eighths of the length of said third strip.

4. In a microstrip interdigitated microwave coupler having an input port, a direct port, a coupled port and an isolated port of the type in which:

said input and coupled ports are at a first longitudinal end of said coupler and said isolated and direct ports are at a second longitudinal end of said coupler, said input port is diagonally opposite said direct port and is connected thereto by:

a first conductive path including a first conductive strip which extends from said input port, a second conductive strip which extends from said direct port, and a first conductive jumper which interconnects the ends of said first and second strips which are remote from said ports, said first and second strips having a combined length which is substantially $\frac{1}{4}$ wavelength at a design frequency, and by a third conductive strip which is substantially $\frac{1}{4}$ wavelength long between said input port and said direct port at said design frequency and to which said first jumper also connects, said coupled port is diagonally opposite said isolated port and is connected thereto by a second conductive path including:

a fourth conductive strip extending from said isolated port and disposed between said first and third strips, a fifth conductive strip extending from said coupled port and disposed between said second and third conductive strips, a second conductive jumper connecting said fourth and fifth conductive strips near said first end of said coupler, and a third conductive jumper connecting said fourth and fifth conductive strips near said second end of said coupler, each of said fourth and fifth conductive strips being substantially $\frac{1}{4}$ wavelength long at said design frequency, the improvement comprising:

said first and second conductive strips having unequal lengths whereby the distance from said input port to said first conductive jumper is different than the distance from said first conductive jumper to said direct port.

5. The improvement recited in claim 4 wherein said first conductive strip is between one eighth and three eighths of the length of said third strip.

6. The improvement recited in claim 4 further comprising:

a fourth conductive jumper connecting said fourth and fifth strips at substantially the same longitudinal distance from said input port as said first conductive jumper connects to said first and second strips.

7. The improvement recited in claim 4 wherein said second conductive strip is between one eighth and three eighths of the length of said third strip.

8. The improvement recited in claim 2 wherein said second conductive strip is between one eighth and three eighths of the length of said third strip.

* * * * *